US005706936A

United States Patent [19]

Bernstein

[11] Patent Number: 5,706,936

[45] Date of Patent: Jan. 13, 1998

[54] PAPERBOARD BOTTLE CARRIER

[75] Inventor: Linda A. Bernstein, Campbell Hall, N.Y.

[73] Assignee: International Paper, Purchase, N.Y.

[21] Appl. No.: 269,328

[22] Filed: Jun. 30, 1994

[51] Int. Cl.[6] ..... B65D 71/00

[52] U.S. Cl. ..... 206/147; 206/153; 206/161; 206/162; 206/145; 206/148; 206/158

[58] Field of Search ..... 206/147, 153, 206/161, 427, 145, 148, 158, 151, 152, 162, 194, 199, 143; 294/87.2, 87.26

[56] References Cited

U.S. PATENT DOCUMENTS

| | | | |
|---|---|---|---|
| Re. 25,781 | 5/1965 | Akeireb . | |
| 2,252,235 | 8/1941 | Snelling . | |
| 2,299,625 | 10/1942 | Holmes . | |
| 2,330,699 | 9/1943 | Flamm . | |
| 2,397,376 | 3/1946 | Singer . | |
| 2,397,716 | 4/1946 | Wendler . | |
| 2,650,128 | 8/1953 | Failor . | |
| 2,737,326 | 3/1956 | Toensmeier . | |
| 2,823,063 | 2/1958 | Toensmeier | 206/158 X |
| 2,823,064 | 2/1958 | Toensmeier | 206/158 X |
| 2,828,047 | 3/1958 | Weiselberg | 206/189 |
| 3,046,711 | 7/1962 | Harrison . | |
| 3,073,644 | 1/1963 | Baker . | |
| 3,085,683 | 4/1963 | Harrison . | |
| 3,156,358 | 11/1964 | Randrup . | |
| 3,640,563 | 2/1972 | Wood . | |
| 3,674,136 | 7/1972 | Forrer . | |
| 3,834,750 | 9/1974 | Gauntlett . | |
| 4,326,628 | 4/1982 | Wood . | |
| 4,378,878 | 4/1983 | Graser . | |
| 4,401,212 | 8/1983 | Fischer . | |
| 4,432,579 | 2/1984 | Denmark et al. | 294/87.2 |
| 4,736,977 | 4/1988 | Killy . | |
| 4,974,771 | 12/1990 | Lavery . | |
| 5,186,321 | 2/1993 | Fadus | 206/151 |

*Primary Examiner*—Paul T. Sewell
*Attorney, Agent, or Firm*—Michael J. Doyle

[57] ABSTRACT

A bottle carrier is formed of one or more panels of paperboard and includes a plurality of bottle neck receiving openings. Each opening has a plurality of radially extending fingers whose ends engage beneath a portion of an abutment associated with each bottle neck. Each finger is bent upwardly at about 45 degrees after insertion of a bottle into a respective opening. Each radial finger is provided with a microcut line extending downwardly from its upper surface, each microcut line extending about 10–50% through the paperboard. The microcut lines weaken the radial fingers and facilitate removal of the bottles from the carrier.

8 Claims, 3 Drawing Sheets

FIG. 2
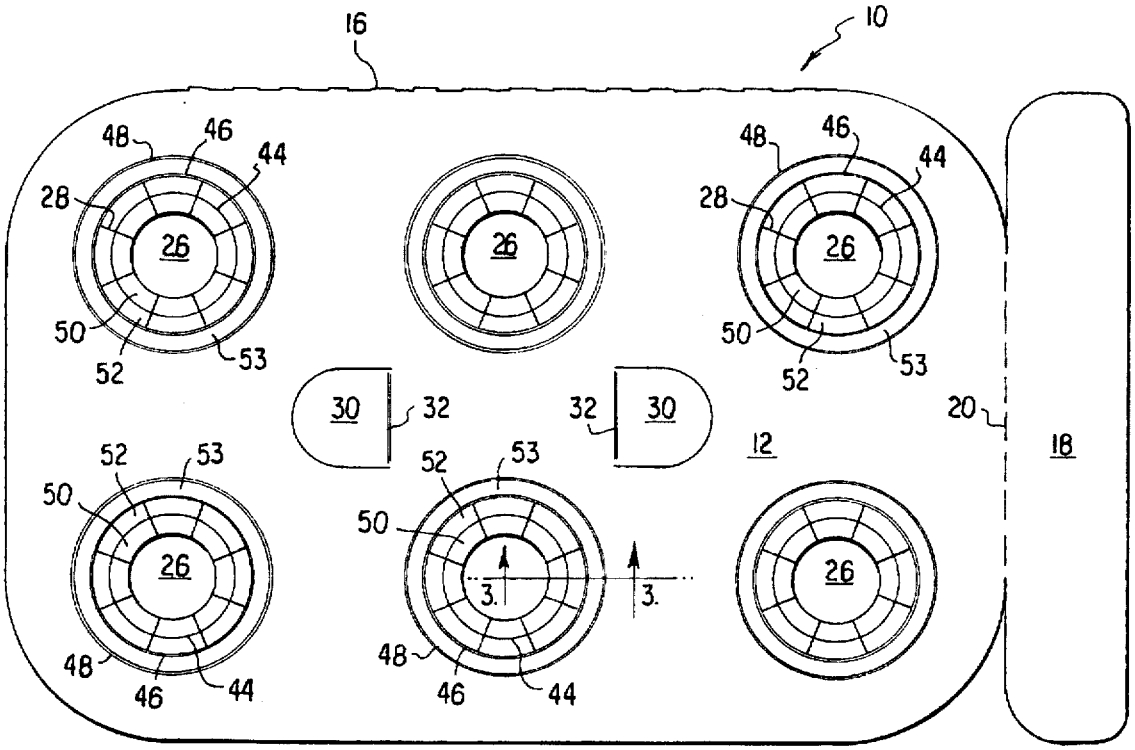
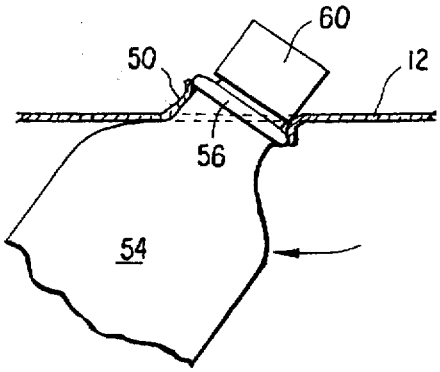
FIG. 5
FIG. 3
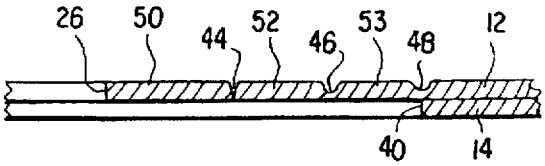

PAPERBOARD BOTTLE CARRIER

BACKGROUND OF THE INVENTION

This invention relates to bottle carriers of the type fashioned from one or more planar sheets of paperboard, the carrier having a plurality of openings for receiving respective bottles. Each bottle receiving opening has a plurality of radially outwardly extending fingers defined by cuts through the paperboard. In general, such carriers have been used largely for cans. Examples of constructions of this general type are shown in U.S. Pat. Nos. 3,834,750 issued to Gauntlett, 3,156,358 issued to Randrup, and 5,125,506 issued to Galbierz et al.

While planar bottle carriers have been relatively successful for carrying cans, such as soft drink cans or the like, they have not been widely accepted for carrying plastic bottles having integral annular flanges around their necks. Generally, the annular flanges associated with bottles, or the screw caps on bottles, are so much larger in diameter than the diameter of the openings in the planar carrier that it is difficult to remove a bottle from its respective opening.

SUMMARY OF THE INVENTION

According to the practice of this invention, known sheet or planar bottle carriers, fashioned as for example from paperboard and having a plurality of radially extending fingers at respective bottle openings, are provided with an annularly continuous microcut (microcut line) extending completely around the opening and spaced radially outwardly therefrom. The microcut line extends approximately 10 to 50% through the thickness of the paperboard, and extends from the top surface towards the bottom surface of the paperboard and not in the opposite direction. Each microcut is thus on that surface of the bottle carrier nearest the top of the bottle associated with that particular opening.

BRIEF DESCRIPTION OF THE DRAWINGS

FIG. 2 is a view similar to FIG. 1 and shows the blank of FIG. 1 after it has been folded about a central fold line, with FIG. 2 showing the top of the bottle carrier.

FIG. 3 is a view taken along section 3—3 of FIG. 2.

FIG. 5 is a view similar to FIG. 4 and illustrates how a bottle is removed from the carrier.

DETAILED DESCRIPTION OF THE INVENTION

Figure 1:
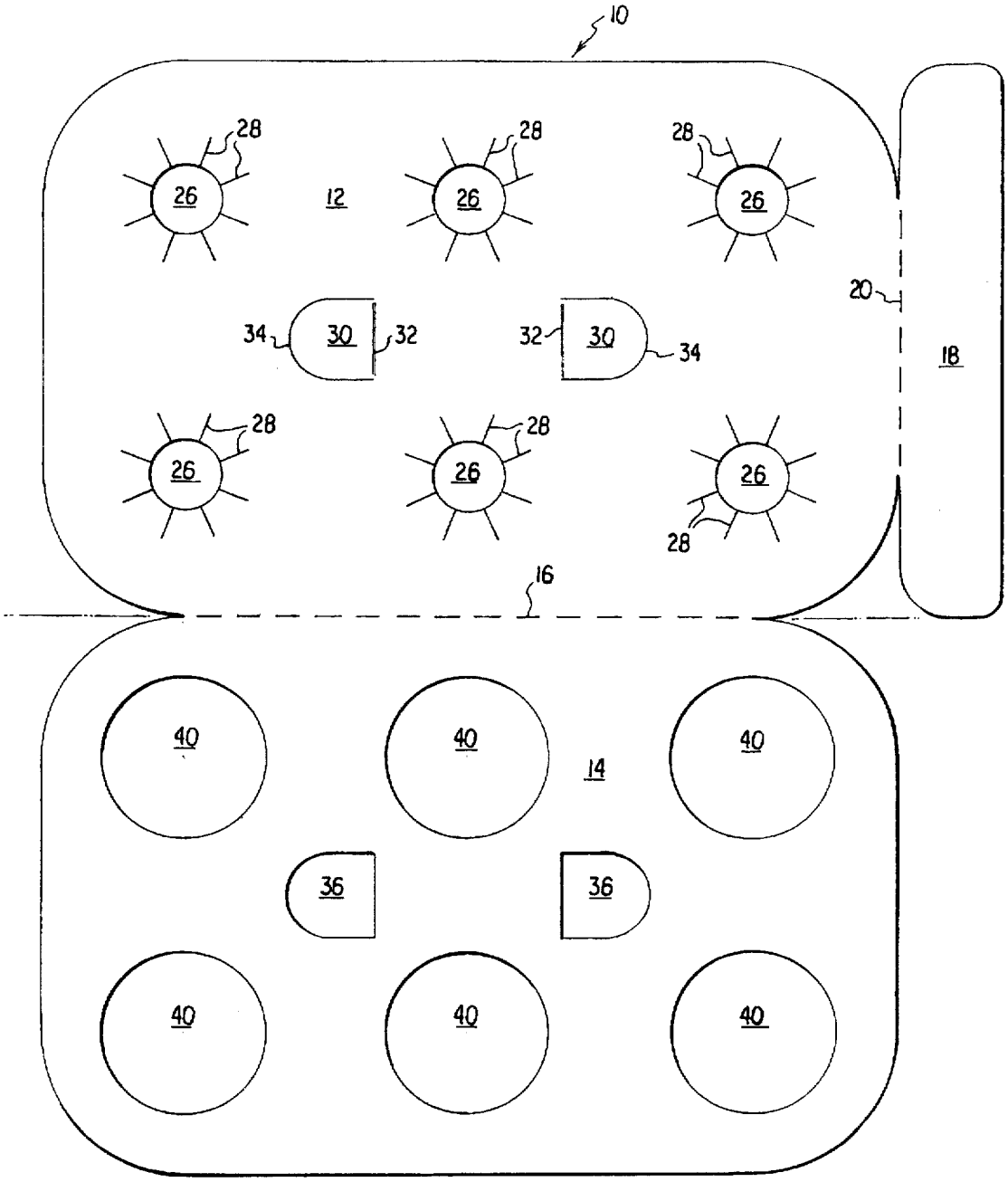
FIG. 1 is a plan view of a unitary blank of paperboard or other flexible, foldable, and resilient sheet material from which the bottle carrier of this invention is fashioned.

Referring now to FIG. 1 of the drawings, the numeral 10 denotes generally a unitary blank of paperboard or other stiff, foldable and resilient sheet material such as 57# Kraft/57# Kraft paperboard, typically of a caliper 0.030 to 0.032 inches. Blank 10 is generally rectangular and has an upper section 12, a lower section 14, both generally rectangular, and a fold line 16 separating and partially defining these two sections. Upper section 12 at one end is provided with an integral extension 18 foldably secured thereto by fold line 20. Upper section 12 is provided with a plurality of regularly arranged openings 26, such as circular openings, with a plurality of radial cut lines 28 extending completely through the paperboard. These radial cut lines are sometimes termed starbursts. Tabs 30 are centrally positioned and are spaced from each other, with each tab 30 defined by a fold line 32 at its base and a generally U shaped cut line 34 extending from the ends of each fold line 32.

Lower section 14 is provided with a pair of openings 36 which are congruent in form and size to tabs 30 of upper section 12. A plurality of bottle receiving openings 40, typically circular, are also provided in lower section 14.

Referring now to FIG. 2, the blank of FIG. 1 has been folded about fold line 16 and glued together. Openings 26 in upper section 12 and openings 40 in lower section 14 are homologous, so that upon folding and glueing the two sections together, respective openings 26 and 40 are pairwise aligned. FIG. 2 shows the top of the bottle carrier of this invention. The top surface of upper section 12 (facing the reader at FIG. 2) differs from the bottom surface of upper section 12, the latter facing the reader at FIG. 1, in the addition, in the top surface of section 12, of circular microcut lines 44 surrounding and located radially outwardly of each opening 26. Microcut lines 44 extend from the top or upper surface of section 12 down towards its bottom or opposite surface, as is shown in FIG. 3, shortly to be described. For each opening 26, the corresponding microcut line 44 intersects radially extending cuts 28. The radially outermost portions of radial cuts 28 terminate at circular and annularly continuous indentation 46, with another circular indentation 48 being located radially outwardly of indentation 46. The intersection of each microcut line 44 with respective radially extending cuts 28 defines a plurality of radially innermost sections 50 and radially outermost sections 52, for each opening 26. The arrangement is such that a plurality of radially extending fingers are formed, with each finger defined by sections 50, 52. Microcut line 44 substantially bisects, in a radial direction, each finger 50,52.

As can be readily visualized, tabs 30 and openings 36 are aligned, with these openings serving as finger lifting openings to permit a user to place a thumb in one opening and the middle finger in the other opening to permit easy carrying of the container.

FIG. 3 shows the aligned relation between openings 26 and 40. Also shown are transverse sections of a microcut line 44 and indentation lines 46 and 48. Microcut line 44 is shown as V shaped in section, but it may be U shaped in practice and is made as by a sharp edged scribe.

Figure 4:
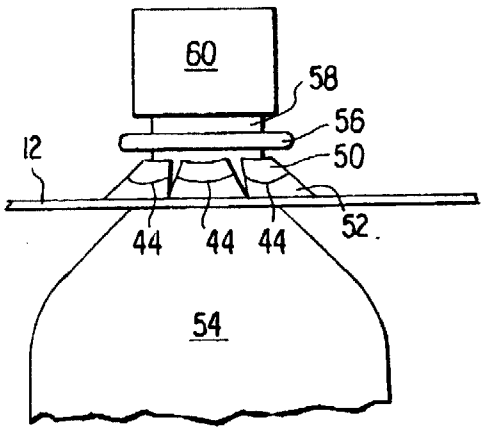
FIG. 4 is a side elevational view showing a bottle supported by the bottle carrier of this invention.

Referring now to FIG. 4, a typical plastic bottle 54, such as one formed by blow molding from polyethylene terephthalate (PET), is shown as engaged with the carrier. In assembling the bottles and carrier, an arrayed group of bottles 54 is located beneath the carrier of FIG. 2, the carrier then pushed downwardly, with each opening 26 aligned with a respective bottle top of the array. Upon completion of the downward travel of the carrier the plane of upper panel 12, the ends of radial fingers 50,52 are beneath integral, annular flange 56 associated with the neck 58 of each bottle. Fingers 50,52 are at a tilt of about 45 degrees to the plane of section 12. Upon later raising the carrier, the weight of each filled bottle causes the lower portion of flange 56 to touch and abut the radially innermost tips of radial fingers 50,52. The clearance between the lower part of flange 56 and the tips fingers 50,52 shown at FIG. 4 is for purposes of illustration.

In the position shown at FIG. 4, each of the radially extending fingers 50,52 is, as noted, approximately at a 45° angle with the plane of upper section 12. There is a downward force on bottle 54, due to the weight of the bottle and its contents, urging radial fingers 50,52 to bend downwardly and through the plane of panel 12, and slant in the other direction and thus release the bottle. However, this is prevented by the resiliency and strength of fingers 50,52 with the result that each bottle 54 remains in place. It will be apparent that with the upward bending of fingers 50,52 the upper edges of each microcut line 44 are urged together, so as to diminish the width of the trough defined by microcuts 44. Thus, each microcut line 44 is effectively squeezed at its top or upper portion. On the other hand, if each microcut 44 were located on the lower surface of upper section 12, then the action would be such to open the trough of each microcut line 44. The latter would be undesirable and might result in the weight of each bottle causing it to fall out of its respective opening.

To remove a bottle from the carrier, the bottle is manually grasped and tilted approximately 45° as shown at FIG. 5. It is then twisted and pulled away and downwardly from the carrier. This tilting of the bottle causes a partial rupture of the paperboard which is at the bottom of each microcut line 44, i.e., beneath microcut line 44 as shown at FIG. 3, to thereby permit easier disengagement form the radial fingers 50,52. Microcut lines 44 thus weaken the paperboard fingers and make easier pulling away or disengagement of a bottle from its corresponding opening 26 and radial fingers 50, 52.

The carrier is typically of double thickness paperboard (sections 12 and 14) because of the strength required to permit carrying the bottles without excessive carrier bending. For smaller or lighter bottles the lower panel or section 14 may be omitted. Side panel 18 functions to carry graphics such as indicia, logos, printing, and may also serve as a detachable coupon.

In the event that a particular bottle design does not include flange 56, the tips of fingers 50,52 would then abut either the lower rim of cap 60 or would abut the bottoms of the screw threads (not illustrated) on the top of the bottle neck. According to the invention, the exact form of the abutment engaged by the free ends of fingers 50,52, namely, flange 56, or the bottom of cap 60, or the bottom of the screw threads, is not critical.

Figure 6:
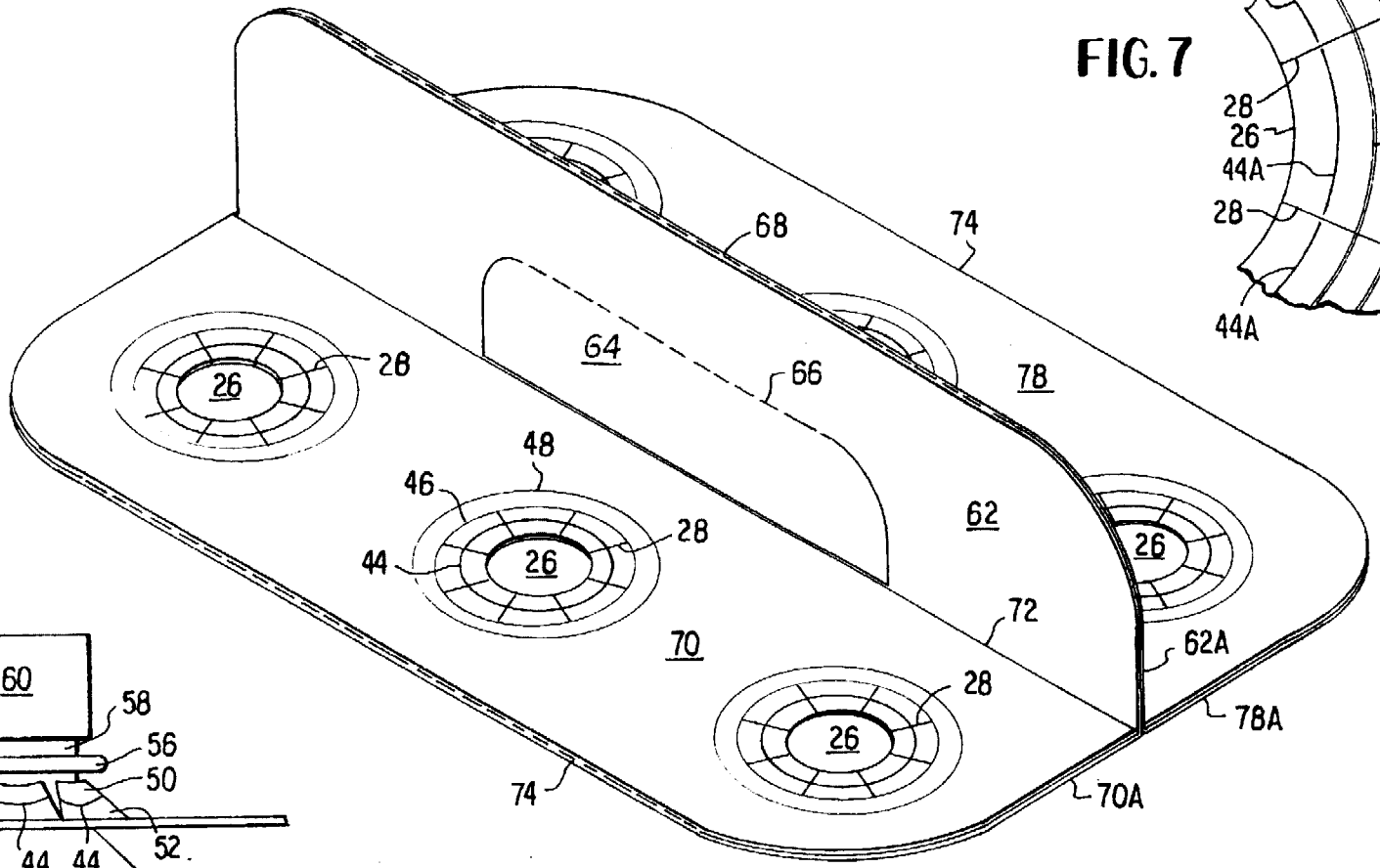
FIG. 6 is a perspective view of another form of a bottle carrier of this invention.

FIG. 6 illustrates a bottle carrier of a different form and is also fashioned from a unitary, generally rectangular paperboard blank. The blank has six panels or sections. Panels 62 and 62A are foldably joined by a middle fold line 68, with a hand hole defined by panel 64 cut at its ends and joined to panel 62 by fold line 66. Opposite panel 62A has corresponding hole forming cuts and fold line, not shown. Top panels 70 and 78 are folded down on lower, congruent panels 70A and 78A respectively. Panels 70 and 70A are joined by fold line 74, while panels 78 and 78A are joined by fold line 74. Panel 70 terminates in free edge 72, with panel 78 having a (not shown) corresponding free edge abutting panel 62A. These free edges are opposite ends of the blank from which the carrier is formed. Lower panels 70A and 78A are provided with openings similar to 40 of FIG. 1, while top panels 70 and 78 are provided with openings 26 and associated radial, microcut and indented lines 28, 44, 46 and 48, respectively, of the type shown in FIGS. 2 and 3.

The carrier of FIG. 6 is loaded in the same manner as previously described. Handle sections 64 and 64A (the latter not shown) are swung outwardly and laterally so as to form a hand hole for carrying.

Figure 7:
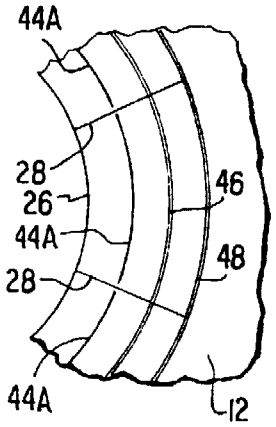
FIG. 7 is a partial plan view of a portion of another form of the bottle receiving openings of the carrier of this invention.

FIG. 7 illustrates a part of one of the carrier openings 26, the latter provided with a different form of microcut line, there denoted a 44A. Instead of one continuous microcut line 44 associated with each opening 26, there are segments 44A each corresponding with one of the radial fingers, with each segment extending less than completely across each radial finger 50,52. There is thus a clearance between the ends of each segment 44A and associated radial cuts 28. The extent of the clearance will vary with the thickness and composition of the paperboard and the weight of the bottles.

Although shown as circular, microcuts 44 may be straight and microcuts 44A may also be straight. Further, they may even be zig-zag. Their function is to weaken the paperboard to enhance bottle removal by permitting breaking of the paperboard across the radial fingers, and hence their exact contour is not critical. From a consideration of FIG. 4, it is seen that radial fingers 50,52 are under compression in supporting the bottles, due to their tilt. Thus weakening the fingers by microcut lines 44, 44A, to permit easier bottle removal, does not significantly affect their compressive strength.

Geometrical terms of orientation, such as upper, lower, and the like, are used to facilitate the description and are not intended as limiting.

I claim:

1. A unitary paperboard blank for forming a bottle carrier, said blank being generally rectangular and having a fold line dividing said blank into upper and lower generally rectangular sections, said upper section having a plurality of bottle neck receiving openings, said bottom section having a like number of openings larger than said openings of said upper section and being homologously arranged so that upon folding said blank about said fold line and overlapping said upper and lower sections, said upper and said lower section bottle neck receiving openings are pairwise aligned, said upper section openings each having a plurality of cut lines extending through said paperboard blank and extending radially outwardly from each said upper section opening to thereby define a plurality of radially extending fingers for each said upper section opening, said upper section having a top surface and a bottom surface, a microcut line substantially transversely intersecting and at least substantially crossing each of said radially extending fingers, to thereby weaken the latter, each said microcut line extending from said top surface of said upper section towards said bottom surface of said upper section, said microcut line dividing each of said fingers into two radially spaced sections.

2. The blank of claim 1 wherein said microcut lines extend about 10 to 50% through said upper section.

3. The blank of claim 1 wherein said microcut line associated with each said bottle neck receiving opening is annularly continuous.

4. The blank of claim 3 wherein said microcut lines extend about 10 to 50% through said upper section.

5. A bottle carrier formed from unitary paperboard panel, said panel having a top surface and a bottom surface, said panel having at least one bottle neck receiving opening, said opening having a plurality of cut lines extending through said paperboard and extending radially outwardly from said opening to thereby define a plurality of radially extending fingers, a microcut line substantially transversely intersecting each of said radially extending fingers, each said microcut line which is associated with each of said fingers extending from said top surface towards said bottom surface, said microcut line dividing each of said fingers into two radially spaced sections.

6. The carrier of claim 5 wherein said microcut lines extend about 10 to 50% through each said finger.

7. The carrier of claim 5 wherein said microcut line associated with said bottle neck receiving opening is annularly continuous.

8. The carrier of claim 7 wherein each said microcut line extends about 10 to 50% through each said finger.

* * * * *